US007238907B2

(12) United States Patent
Ito

(10) Patent No.: US 7,238,907 B2
(45) Date of Patent: Jul. 3, 2007

(54) KEYBOARD WITH KEY SUPPORTING STRUCTURE

(75) Inventor: Hideki Ito, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 213 days.

(21) Appl. No.: 10/726,354

(22) Filed: Dec. 2, 2003

(65) Prior Publication Data

US 2004/0118665 A1 Jun. 24, 2004

(30) Foreign Application Priority Data

Dec. 3, 2002 (JP) ..... 2002-350993
Mar. 26, 2003 (JP) ..... 2003-084969

(51) Int. Cl.
*H01H 13/70* (2006.01)

(52) U.S. Cl. ..... 200/344

(58) Field of Classification Search ..... 200/5 A, 200/517, 344, 345; 400/490, 491, 491.2, 400/495, 495.1, 496
See application file for complete search history.

(56) References Cited

U.S. PATENT DOCUMENTS 5,823,325 A * 10/1998 Lin ..... 200/344
5,874,697 A * 2/1999 Selker et al. ..... 200/5 A
6,509,536 B2 * 1/2003 Sasaki ..... 200/344
6,572,289 B2 * 6/2003 Lo et al. ..... 400/491.3
6,686,549 B2 * 2/2004 Douzono et al. ..... 200/341
6,706,985 B2 * 3/2004 Chun ..... 200/344

FOREIGN PATENT DOCUMENTS

| | | |
|---|---|---|
| JP | 4-76224 | 3/1992 |
| JP | 6-036647 | 2/1994 |
| JP | 11-3158 | 1/1999 |
| JP | 11-016440 | 1/1999 |

* cited by examiner

*Primary Examiner*—Michael A. Friedhofer
(74) *Attorney, Agent, or Firm*—Brinks Hofer Gilson & Lione

(57) ABSTRACT

In a keyboard including a plurality of keys, each key has a key top, a guiding structure that includes linking units pivotally movable in response to vertical motion of the key top, an elastic member to be pressed down by the vertical motion of the key top, and a contact which is operatively associated with the vertical motion of the key top. The guiding structure includes a common unit which is shared with all the other keys.

9 Claims, 6 Drawing Sheets

KEYBOARD WITH KEY SUPPORTING STRUCTURE

BACKGROUND OF THE INVENTION

1. Field of the Invention

The present invention relates to a keyboard including a plurality of keys, more specifically, to a structure for supporting the keys of the keyboard.

2. Description of the Related Art

Known keyboards for use with electrical devices such as personal computers and word processors include a key top having a sliding unit on its inner surface and a base having a cylindrical guide. The sliding unit is slidably connected to the guide so as to move vertically (See Japanese Unexamined Patent Application Publication No. 11-3158 (hereinafter Document 1), in particular, FIG. 13 and Japanese Unexamined Utility Model Registration Application Publication No. 4-76224 (hereinafter Document 2), in particular, FIG. 3). Upon depression of the key by an operator, the key top is pressed down and the sliding unit comes into contact with a contact to input data that the key represents and the sliding unit is then returned to its original position by an elastic member such as a spring or a rubber piece.

Unfortunately, keyboards of this type have a drawback in that a short sliding unit and guide in a low-profile construction render the key top loose and unstable since the position of the key top is fixed by connecting the sliding unit to the guide (See page 2 in Document 2 and Japanese Unexamined Patent Application Publication No. 6-36647 (hereinafter Document 3), in particular, paragraph 0003). In this regard, this type of keyboard is unsuitable for low-profile or miniaturized constructions.

To this end, keyboards free from the aforementioned sliding unit and guide are being developed. A keyboard of an improved type includes key tops, each having a support composed of two hinges and a switch. In this keyboard, two hinges are fixed to an inner surface of a key top and a base such that the hinges are intersected when viewed from the side. The hinges are movably engaged with one another at the pivotal axis of the intersection. The top end of the hinge is slidably connected to a holding portion provided on the inner surface of the key top and the bottom end of the hinge is slidably connected to a holding portion provided on the base (See claim of Document 2 and claim 1 of Document 3).

Another improved keyboard has a supporting structure such that at least two hinges incline outward from the base. These hinges are disposed orthogonal to each other but not intersected when viewed from the top. These hinges are provided for each key such that top ends of the hinges are pivotally connected to the inner surface of the key top, and the bottom ends of the hinges are slidably connected to a base (See Japanese Unexamined Patent Application Publication No. 11-16440 (hereinafter Document 4), in particular, claim 1 and FIGS. 1–6).

These known keyboards described in Documents 2 to 4 require separate hinges for each key and assembly of the separate hinges.

SUMMARY OF THE INVENTION

It is an object of the present invention to provide an inexpensive keyboard which can be assembled with a reduced number of pieces and assembly steps.

It is another object of the present invention to provide a keyboard manufactured readily in a low-profile construction with a reduced size and weight.

It is a further object of the present invention to provide a keyboard constructed such that a key top is evenly depressed without tilting even if an off-center depression force is applied on the key top from the finger.

The keyboard according to the present invention comprises a plurality of keys and each key comprises a key top, a guiding structure including at least one linking unit pivotally movable in response to vertical motion of the key top, an elastic member to be pressed down by the vertical motion of the key top, and a contact operatively associated with the vertical motion of the key top, wherein the guiding structure has a first common unit which is shared with the other keys.

In the thus constructed keyboard, the guiding structure includes a first common unit which is shared with the other keys such that only a smaller number of pieces and assembly steps is required, resulting in reduced manufacturing costs and time. In addition, the assembly steps are simplified, thereby improving the yield of the keyboard.

According to the keyboard of the present invention, preferably the first common unit is a board disposed below the key top, and the guiding structure includes a first linking unit that is formed by cutting out the board.

The thus constructed keyboard is readily manufactured in a low-profile construction with a reduced size and weight.

In the keyboard according to the present invention, in addition to the first linking unit, preferably the guiding structure includes a second linking unit that is formed by bending a rod.

The thus constructed keyboard can control the motion of the key top by the first and second linking units. Therefore, the key top is evenly depressed without tilting even if off-center depression force is applied on the key top.

According to the keyboard of the present invention, in addition to the first linking unit, preferably the guiding structure includes a second linking unit which is formed by cutting out a second common unit that is a board and is shared with the other keys.

In the thus constructed keyboard, not only the first linking unit but also the second linking unit is shared with all the other keys such that the keyboard can be manufactured with a further smaller number of pieces and assembly steps, resulting in reduced manufacturing costs and time. Additionally, the assembly steps are further simplified, thereby improving the yield of the keyboard. Furthermore, the first and second linking units are formed by cutting out the first and second common units, respectively. The keyboard can be manufactured in a low-profile construction with a reduced size and weight. The first and second linking units control the motion of the key top. Thus, the key top is evenly depressed without tilting even if off-center depression force is applied on the key top.

In the keyboard according to the present invention, the first linking unit and the second linking unit may be pivotally intersected when viewed from the side.

In such a keyboard, the first and second linking units are operatively associated to control the motion of the key top. Therefore, the key top is evenly depressed without tilting even if off-center depression force is applied on the key top.

In the keyboard according to the present invention, the guiding structure may include a plurality of linking units which is formed by cutting out a first common unit.

Such a keyboard can be manufactured with a smaller number of pieces and assembly steps, resulting in reduced manufacturing costs and time. Additionally, the key top is supported by the plurality of linking units such that the key top is evenly depressed without tilting even if off-center depression force is applied on the key top.

In the keyboard of the present invention, preferably the pivotal axis of one of the plurality of linking units may be disposed orthogonal to the pivotal axis of another linking unit when viewed from the top.

With such a keyboard, one linking unit prevents the key top from tilting in one direction and another linking unit prevents the key top from tilting in another direction. Thus, the key top is depressed evenly.

DESCRIPTION OF THE PREFERRED EMBODIMENTS

Figure 1:
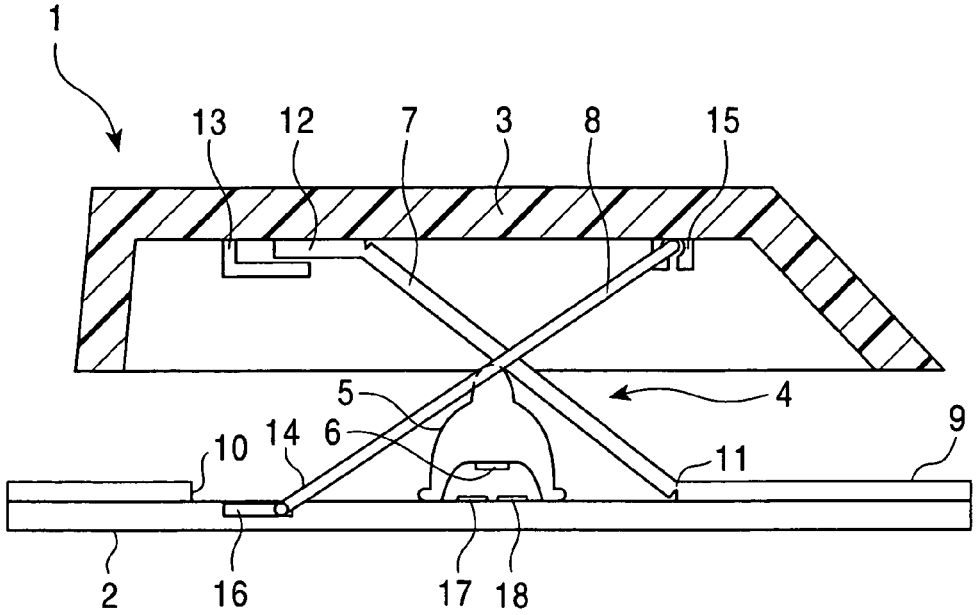
FIG. 1 is a cross-sectional view of a keyboard according to the present invention.
Figure 2:
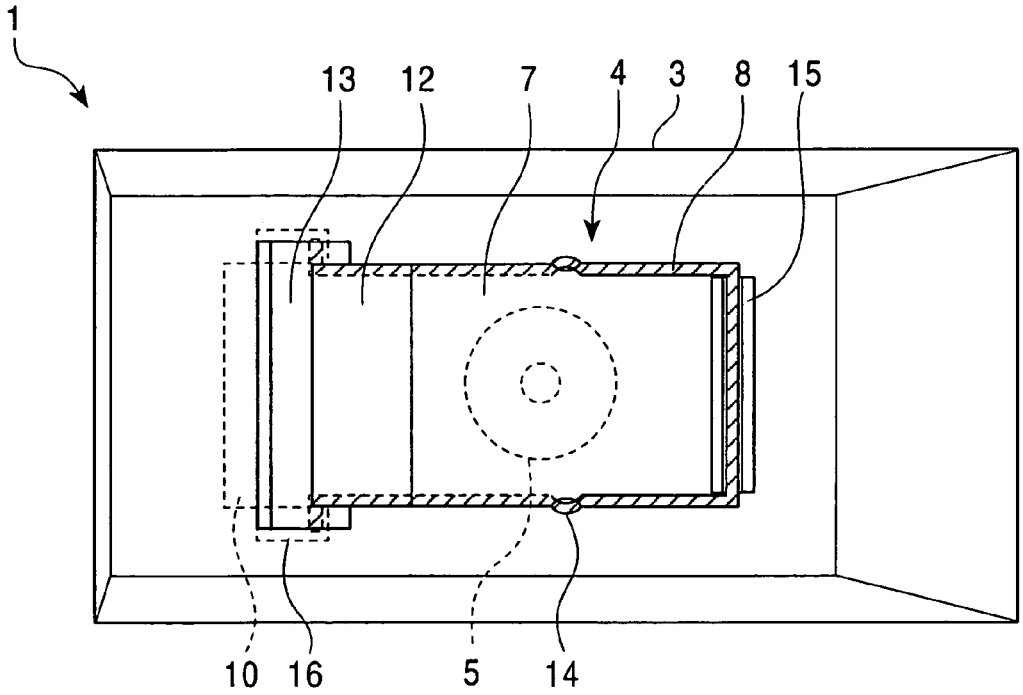
FIG. 2 is a plan view of the keyboard shown in FIG. 1.
Figure 3:
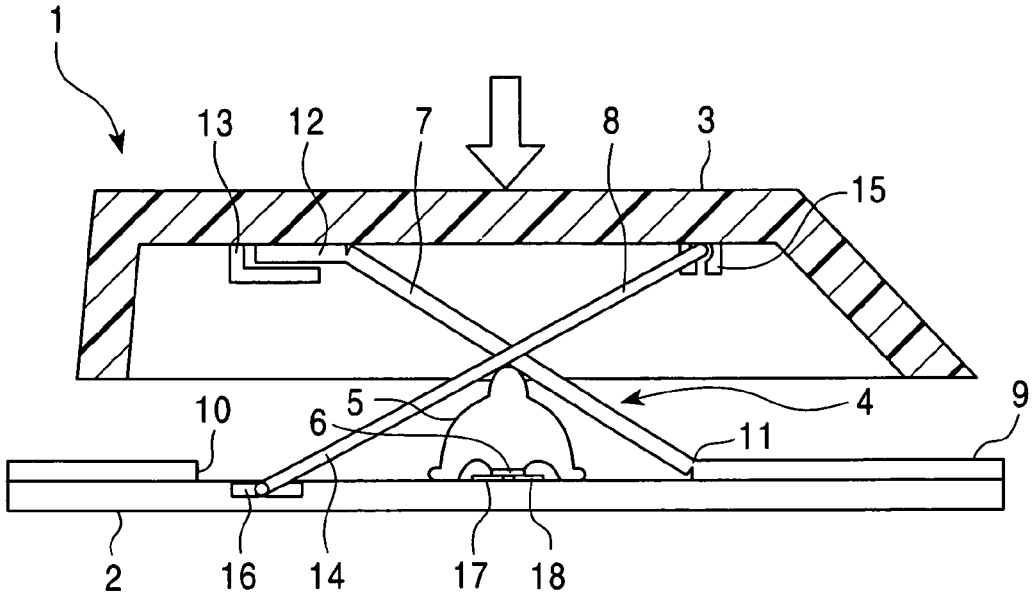
FIG. 3 is a cross-sectional view of the keyboard shown in FIG. 1 when the key top is depressed.
Figure 4:
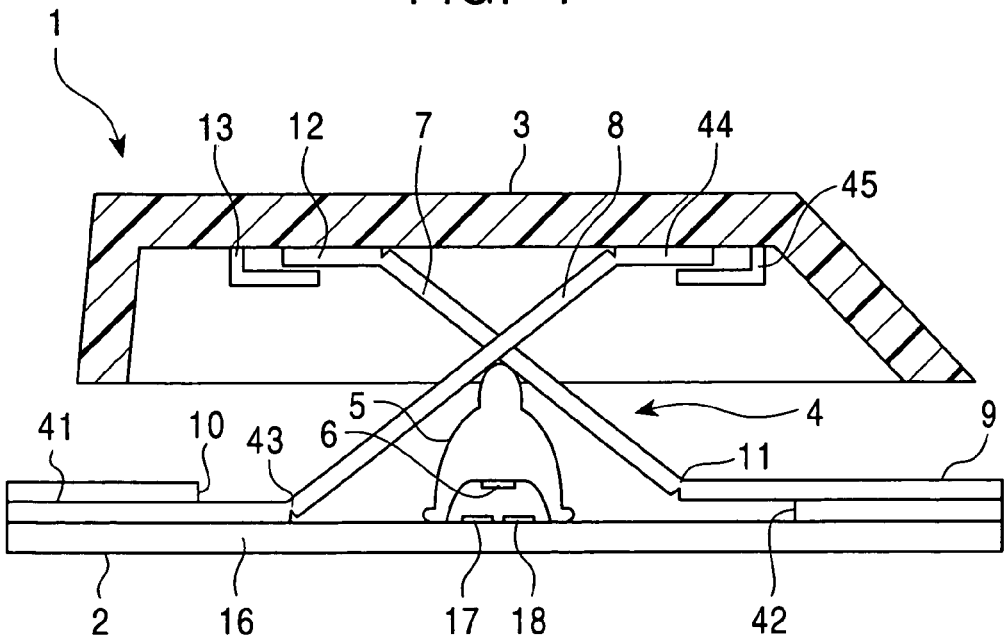
FIG. 4 is a cross-sectional view of a modification of the keyboard according to the present invention.

Embodiments of the present invention will now be described by referring to the drawings. FIG. 1 is a cross-sectional view of a keyboard according to the present invention. FIG. 2 is a plan view of the keyboard shown in FIG. 1. In FIG. 2, parts disposed below a point where the first linking unit 7 and the second linking unit 8 are intersected are indicated by dotted lines. FIG. 3 is a cross-sectional view of the keyboard shown in FIG. 1 when the key is depressed. FIG. 4 is a cross-sectional view of a modification of the keyboard shown in FIG. 1.

A keyboard 1 of the present invention includes a plurality of keys on a base 2 and each key includes a key top 3, a guiding structure 4, an elastic member 5, and a contact 6. The base 2 includes a printed circuit board, a support plate and a frame below the key top 3. The key top 3 is depressed by a user to enter data and is typically formed by molding a synthetic resin such as an ABS resin.

The guiding structure 4 includes a first linking unit 7. This first linking unit 7 is formed of a common first guiding unit 9 that is shared with all the keys. The first guiding unit 9 is cut out along a cut section 10 and the cutout portion is folded upward at a folded corner 11.

The first guiding unit 9 is a board provided below the key top 3. The first guiding unit 9 has an area larger than or equal to the areas of all the keys. The first guiding unit 9 is cut out to form the first linking unit 7 for each key. The first guiding unit 9 is composed of a synthetic resin or a metal. The first linking unit 7 may be cut out along the cut section 10 during or after forming the first guiding unit 9.

The folded corner 11 functions as a fixed hinge for pivotally moving an inclined portion of the first linking unit 7. For facilitating pivotal motion of the first linking unit 7, a slit may be provided at the folded corner 11 as shown in FIGS. 1 and 3. An adhesive tape may be affixed to the top surface of the folded corner 11 to prevent the first linking unit 7 from being detached at the folded corner 11.

A top end 12 of the first linking unit 7 is in contact with the inner surface of the key top 3. To ensure that the key top 3 is evenly depressed, preferably the top end 12 and the inclined portion of the first linking unit 7 are hinged so that the angle between the inner surface of the key top 3 and the inclined portion of the first linking unit 7 is changeable. Furthermore, it is preferred that the top end 12 be slidably connected to the inner surface of the key top 3 so that the key top 3 is vertically depressed without shifting laterally.

In FIG. 1, the top end 12 of the first linking unit 7 is slidably connected to the inner surface of the key top 3, and the angle between the inner surface of the key top 3 and the inclined portion of the first linking unit 7 is changeable. That is, the top end 12 and the inclined portion of the first linking unit 7 form a slidable hinge. Preferably, the folded top end 12 is leveled so that the top end 12 is in contact with the inner surface of the key top 3 with a large area. Thus, the key top 3 operates stably. Preferably, a holder 13 is provided on the inner surface of the key top 3 in order to prevent the key top 3 from tilting.

The shape of the first linking unit 7 is determined by the cut section 10. FIGS. 6A to 6D illustrate variations of the cut section 10 in the first guiding unit 9. In FIGS. 6A to 6D, the cut section 10 is indicated by a solid line, an inwardly folded portion 61 is indicated by a dotted line, an outwardly folded portion 62 is indicated by a dashed line, and the top end 12 in contact with the key top 3 is indicated by hatching.

Figure 6A:
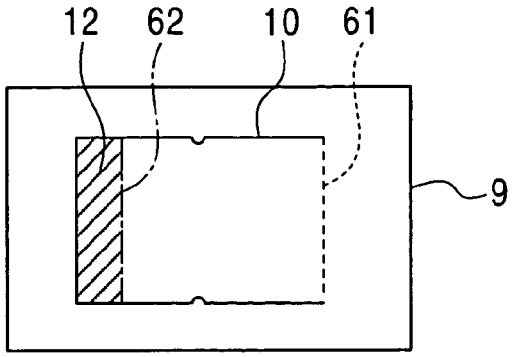
FIGS. 6A to 6D are plan views showing variations of a first linking unit.
Figure 6B:
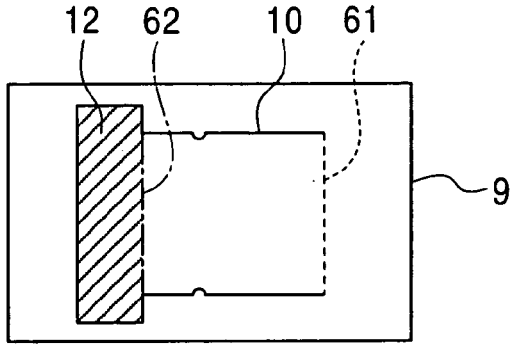
Figure 6C:
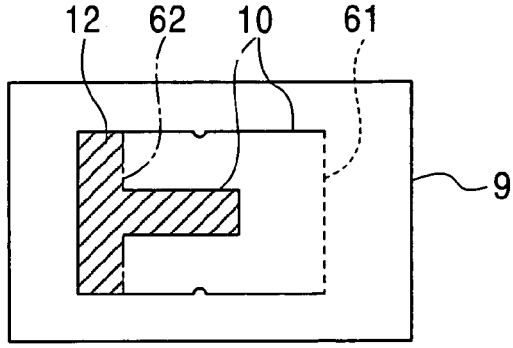
Figure 6D:
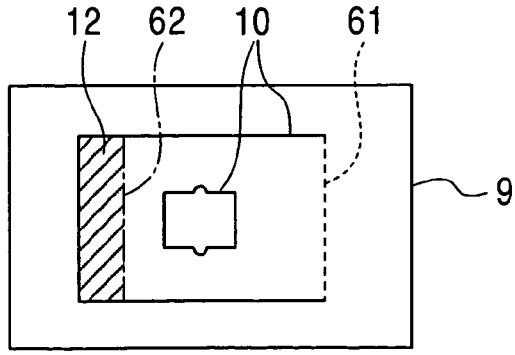

To form the rectangular first linking unit 7 as shown in FIGS. 1 to 3, the cut section 10 is formed in a rectangular U-shape as shown in FIG. 6A. As shown in FIG. 6B, the top end 12 may be wider, thereby increasing the contact area with the key top 3. As shown in FIG. 6C, another cut section 10 in a rectangular U-shape may also be formed in the inclined portion of the first linking unit 7 to make the top end 12 longer in the lateral direction of the drawing, thereby preventing inclination of the key top 3. As shown in FIG. 6D, a hole may be formed in the inclined portion of the first linking unit 7 to reduce the weight thereof.

Preferably, the guiding structure 4 has a second linking unit 8 to keep the key top 3 leveled during its vertical motion. In FIGS. 1 and 4, the first linking unit 7 and the second linking unit 8 are intersected when viewed from the side and pivotally connected at the intersected section.

Figure 5:
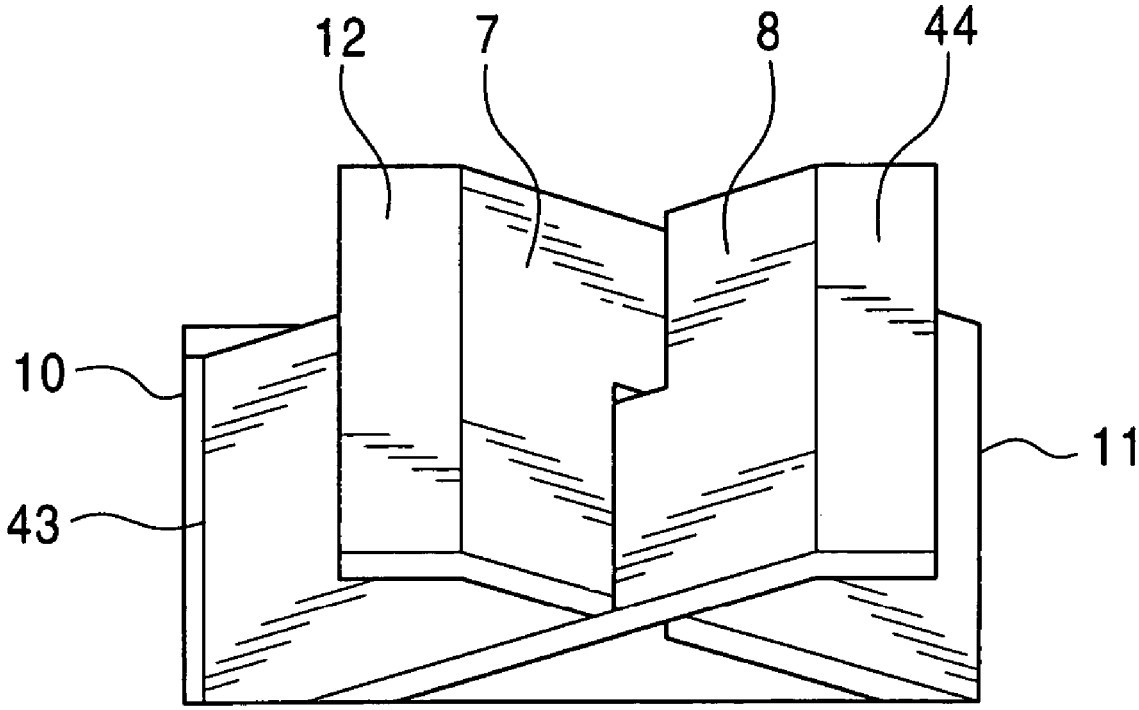
FIG. 5 is a cross-sectional view of another modification of the keyboard according to the present invention.

The second linking unit 8 may be composed of a rod 14 that is bent in a predetermined shape as shown in FIGS. 1 to 3 or may be formed by cutting out a common second guiding unit 41, which is shared with all the keys, along a cut section 42 as shown in FIGS. 4 and 5.

When the second linking unit 8 is composed of the rod 14, one of the corner between the top surface of the base 2 and an inclined portion of the rod 14 and the corner between the inner surface of the key top 3 and the inclined surface of the rod 14 is a fixed hinge and the other is a slidable hinge. To form a fixed hinge, an end of the rod 14 is folded outwardly or inwardly and the folded end is inserted into a bearing, the folded corner being the pivotal axis. To form a slidable hinge, the end of the rod 14 is folded outwardly or inwardly and the folded end is inserted into a groove.

In FIGS. 1, 2, and 3, the top end of the rod 14 is folded inwardly and the folded top end is inserted into a bearing 15 provided on the inner surface of the key top 3. The inclined portion of the rod 14 and the inner surface of the key top 3 form a fixed hinge, the folded corner functioning as the pivotal axis of the fixed hinge. On the other hand, the bottom end of the rod 14 is folded outwardly and the folded bottom end is inserted into a groove 16 provided on the base 2. The folded bottom end and the inclined portion of the rod 14 form a slidable hinge.

In forming the second linking unit 8 out of the second guiding unit 41, the second guiding unit 41 is formed between the base 2 and the first guiding unit 9 or on the first guiding unit 9. Similar to the first linking unit 7, the second guiding unit 41 is cut out along the cut section 42 and the cutout is folded upward at a folded corner 43. In this case, the folded corner 43 is a fixed hinge, and an end portion 44 and an inclined portion of the second linking unit 8 form a slidable hinge.

Similar to the first linking unit 7, when the folded end portion 44 of the second linking unit 8 is leveled, the key top 3 operates stably. Preferably, a holder 45 is provided on the inner surface of the key top 3, thereby preventing the key top 3 from tilting.

When the second guiding unit 41 is formed under the first guiding unit 9, the second linking unit 8 is cut out through an opening which is formed when cutting out the first guiding unit 9 in the formation of the first linking unit 7.

When the second linking unit 8 is composed of the rod 14, the first linking unit 7 and the rod 14 are intersected by inserting the rod 14 into a recess formed in the inclined portion of the first linking unit 7. This recess has a larger width than the inclined portion of the rod 14; thus the inserted rod 14 is leaned against the first linking unit 7. Alternatively, another recess may be formed in the inclined portion of the rod 14 so that the first linking unit 7 and the rod 14 are joined together by the recesses as shown in FIGS. 1, 2, and 3.

When the second linking unit 8 is formed by cutting out the second guiding unit 41 as shown in FIGS. 4 and 5, the first linking unit 7 and the second linking unit 8 are provided with grooves in the inclined portions thereof and are intersected by engaging the grooves.

It is unnecessary that the pivotal axes of a plurality of linking units are disposed parallel to each other. Specifically, when the pivotal axis of one of these linking units is disposed orthogonal to the pivotal axis of another linking unit, the key top 3 can keep itself leveled during its vertical motion.

Figure 7:
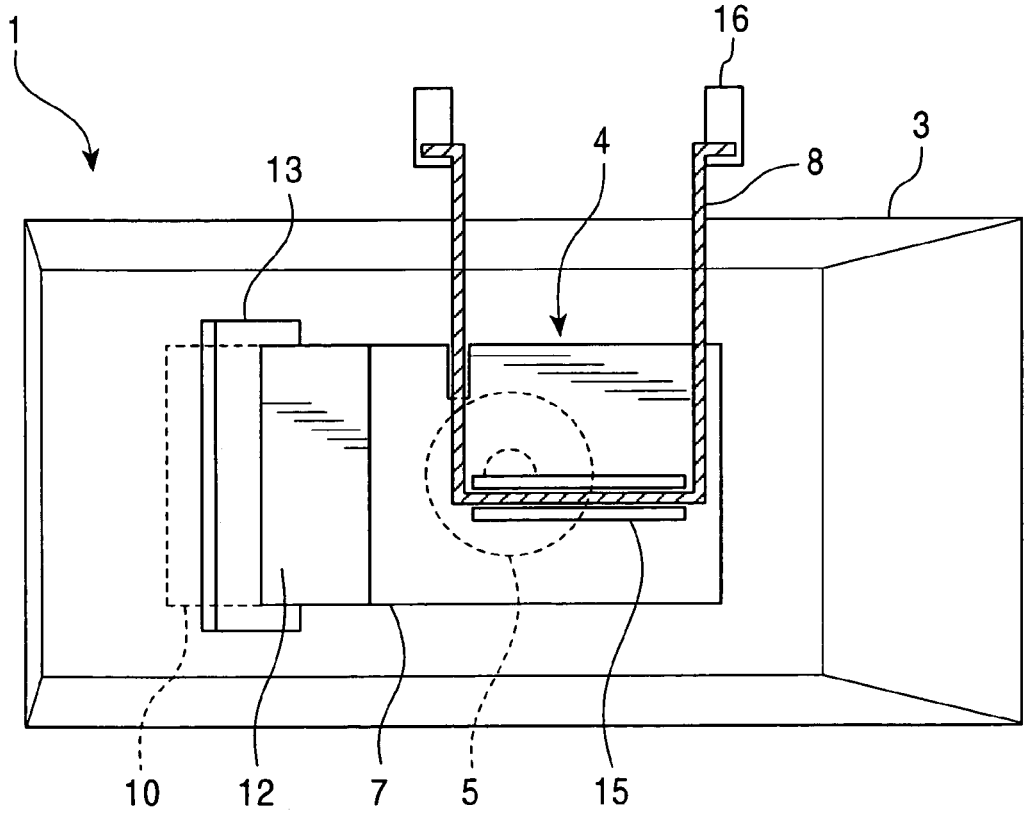
FIG. 7 is a plan view of another modification of the keyboard according to the present invention.

Referring to FIG. 7, the pivotal axis of the second linking unit 8 is disposed orthogonal to that of the first linking unit 7 in the keyboard 1 shown in FIGS. 1 and 2. The first linking unit 7 is in contact with the inner surface of the key top 3 in the longitudinal direction, thereby preventing the key top 3 from tilting in the longitudinal direction. On the other hand, the second linking unit 8 is in contact with the inner surface of the key top 3 in the lateral direction, thereby preventing the key top 3 from tilting in the lateral direction. Accordingly, the key top 3 can keep itself leveled during its vertical motion.

Figure 8A:
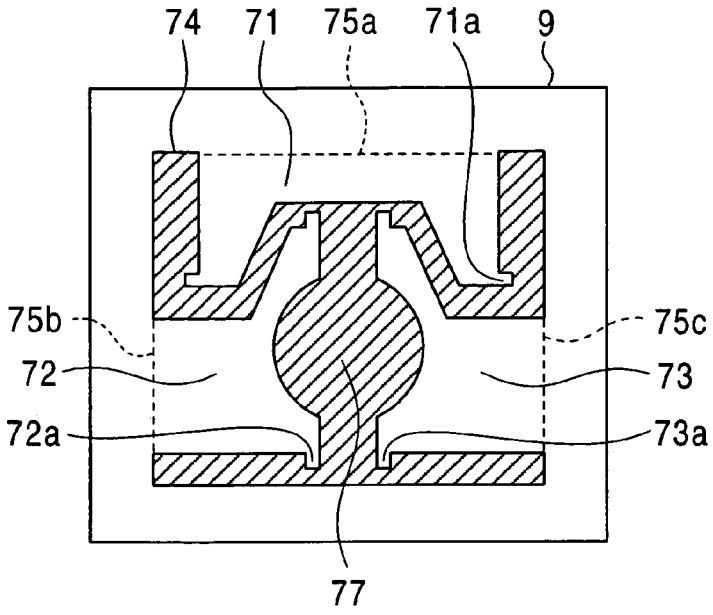
FIG. 8A is a plan view of a guiding unit according to another modification of the keyboard of the present invention.
Figure 8B:
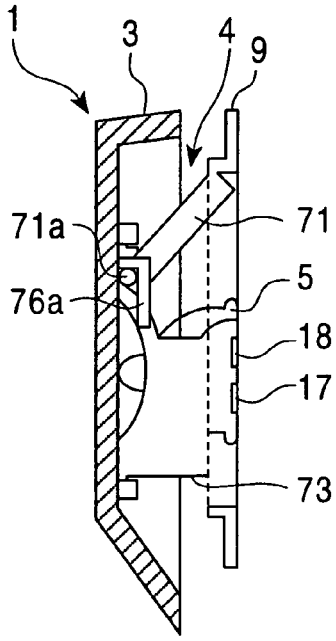
FIG. 8B is a side view of the keyboard including the guiding unit shown in FIG. 8A.
Figure 8C:
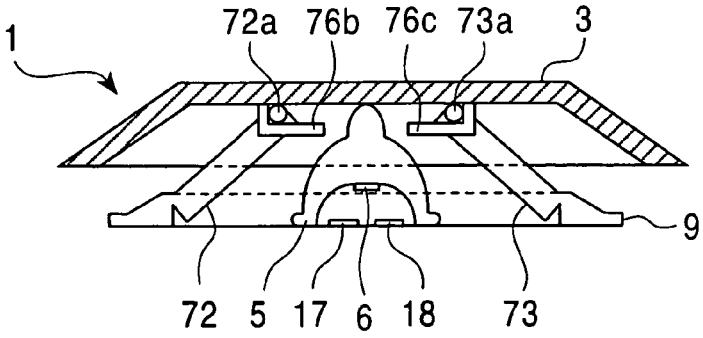
FIG. 8C is a plan view of the keyboard including the guiding unit shown in FIG. 8A.

Alternatively, the first guiding unit 9 may include more than two linking units per one key top 3 as shown in FIGS. 8A to 8C. FIG. 8A is a plan view of the first guiding unit 9 according to a modification of the keyboard 1 of the present invention. FIG. 8B is a right side view of the keyboard 1 including the first guiding unit 9 shown in FIG. 8A. FIG. 8C is a front view of the keyboard 1 including the first guiding unit 9 shown in FIG. 8A.

In FIG. 8A, the first guiding unit 9 includes a first linking unit 71, a second linking unit 72, and a third linking unit 73. The first linking unit 71, the second linking unit 72, and the third linking unit 73 are cut out along a cut section 74 and pivotally move at folded corners 75*a*, 75*b*, and 75*c* separately. The folded corners 75*a*, 75*b*, and 75*c* are fixed hinges of the first linking unit 71, the second linking unit 72, and the third linking unit 73, respectively.

The first linking unit 71, the second linking unit 72, and the third linking unit 73 are respectively provided with projections 71*a*, 72*a*, and 73*a* at their top ends. These projections 71*a*, 72*a*, and 73*a* function as pivotal axes of their respective linking units and are inserted into grooves 76*a*, 76*b*, and 76*c* which are formed on the inner surface of the key top 3. The first linking unit 71, the second linking unit 72, and the third linking unit 73 are slidably connected to the inner surface of the key top 3 and the angles between the inner surface of the key top 3 and the inclined portions of the linking units are changeable. Accordingly, each corner of the inner surface of the key top 3 and the first linking unit 71, the second linking unit 72, and the third linking unit 73 is a slidable hinge.

The pivotal axis of the first linking unit 71 is disposed orthogonal to the pivotal axes of the second linking unit 72 and the third linking unit 73. Therefore, the first linking unit 71 is in contact with the inner surface of the key top 3 in the lateral direction, thereby preventing the key top 3 from tilting in the lateral direction. The second linking unit 72 and the third linking unit 73 are in contact with the inner surface of the key top 3 in the longitudinal direction, thereby preventing the key top 3 from tilting in the longitudinal direction.

As shown in FIGS. 8B and 8C, the inclined portions of the first linking unit 71, the second linking unit 72, and the third linking unit 73 are thicker than the rest of the first guiding unit 9 and thus have enhanced strength.

The elastic member 5 is disposed below the first linking unit 7 and the second linking unit 8 to push back the depressed key top 3 to its original position. The elastic member 5 is composed of, for example, a rubber piece or a spring.

In the keyboard 1 shown in FIGS. 1 to 3, the elastic member 5 is disposed below the first linking unit 7. Upon depression of the key top 3, the inclined portion of the first linking unit 7 presses down the elastic member 5.

In the keyboard 1 shown in FIG. 4, the elastic member 5 is disposed below the intersection of the first linking unit 7 and the second linking unit 8. When the key top 3 is depressed, the inclined portions of the first linking unit 7 and the second linking unit 8, in turn, press down the elastic member 5.

In the keyboard 1 shown in FIGS. 8A to 8C, the elastic member 5 is disposed in an opening 77 which is formed by curving the end portions of the second linking unit 72 and the third linking unit 73. Thus, the key top 3 directly presses down the elastic member 5.

The contact 6 is operatively associated with the vertical motion of the key top 3. That is, upon depressing the key, the contact 6 comes into contact with another contact, thereby generating an electrical signal. As shown in FIGS. 1, 3, and 4, the elastic member 5 is hollowed at its bottom and the contact 6 is attached on the hollow bottom of the elastic member 5. A contact 17 and a contact 18 are provided on the top surface of the base 2. Upon depression of the elastic member 5, the hollow at the bottom of the elastic member 5 becomes flat and the contact 6 comes into contact with the contact 17 and the contact 18 as shown in FIG. 3. After that, the key top 3 is returned to its original position by the elastic member 5 and the contact 6 is detached from the contact 17 and the contact 18. Alternatively, the contact 6 may be provided directly on the key top 3.

What is claimed is:

1. A keyboard comprising a plurality of keys, each of the keys comprising:

a key top;

a guiding structure including at least one linking unit pivotally movable in response to vertical motion of the key top;

an elastic member to be pressed down by the vertical motion of the key top; and a contact operatively associated with the vertical motion of the key top, wherein the guiding structure has a first common unit which is shared with the other keys and the guiding structure includes a plurality of linking units which is formed by cutting out the first common unit.

2. A keyboard according to claim 1, wherein the first common unit is a board disposed below the key top, and the guiding structure includes a first linking unit that is formed by cutting out the board.

3. A keyboard according to claim 2, wherein the guiding structure includes a second linking unit that is formed by bending a rod.

4. A keyboard according to claim 2, wherein the guiding structure includes a second linking unit which is formed by cutting out a second common unit that is a board and is shared with the other of the keys and is disposed below the key top.

5. A keyboard according to claim 3, wherein the first linking unit and the second linking unit are pivotally intersected when viewed from the side.

6. A keyboard according to claim 1, wherein the pivotal axis of one of the plurality of linking units is disposed orthogonal to the pivotal axis of another of the linking units when viewed from the top.

7. A keyboard comprising a plurality of keys, each of the keys comprising:

a key top;

a guiding structure including at least one linking unit pivotally movable in response to vertical motion of the key top;

an elastic member to be pressed down by the vertical motion of the key top; and a contact operatively associated with the vertical motion of the key top, wherein the guiding structure has a first common unit which is shared with the other keys, the first common unit is a board disposed below the key top, the guiding structure includes a first linking unit that is formed by cutting out the board and a second linking unit that is formed by bending a rod.

8. A keyboard according to claim 7, wherein the first linking unit and the second linking unit are pivotally intersected when viewed from the side.

9. A keyboard comprising a plurality of keys, each of the keys comprising:

a key top;

a guiding structure including at least one linking unit pivotally movable in response to vertical motion of the key top;

an elastic member to be pressed down by the vertical motion of the key top; and a contact operatively associated with the vertical motion of the key top, wherein the guiding structure has a first common unit which is shared with the other keys, the first common unit is a board disposed below the key top, the guiding structure includes a first linking unit that is formed by cutting out the board and a second linking unit which is formed by cutting out a second common unit that is a board and is shared with the other of the keys and is disposed below the key top.

* * * * *